US007946464B2

(12) United States Patent
Dion et al.

(10) Patent No.: US 7,946,464 B2
(45) Date of Patent: May 24, 2011

(54) ACTUATOR HOUSING HAVING A RELEASABLE ACTUATOR CARTRIDGE FOR USE ON HARDWOOD FLOORING PNEUMATIC NAILERS

(75) Inventors: Marc Dion, St-Augutin-de-Desmaures (CA); Maxime Dupont, Quebec (CA); David Lavoie, Charlesbourg (CA); Jacques Maltais, Beauport (CA)

(73) Assignee: Laboratoire Primatech Inc., Quebec (CA)

( * ) Notice: Subject to any disclaimer, the term of this patent is extended or adjusted under 35 U.S.C. 154(b) by 301 days.

(21) Appl. No.: 12/297,230

(22) PCT Filed: May 1, 2006

(86) PCT No.: PCT/CA2006/000700
§ 371 (c)(1),
(2), (4) Date: Oct. 15, 2008

(87) PCT Pub. No.: WO2007/124555
PCT Pub. Date: Nov. 8, 2007

(65) Prior Publication Data

US 2009/0166392 A1 Jul. 2, 2009

(51) Int. Cl.
*B25C 1/04* (2006.01)

(52) U.S. Cl. ..... 227/148; 227/130

(58) Field of Classification Search ..... 227/8, 9, 227/10, 130, 147, 148
See application file for complete search history.

(56) References Cited

U.S. PATENT DOCUMENTS 2,353,450 A * 7/1944 Fischer ..... 72/312
3,051,135 A 3/1959 Smith
2,881,738 A * 4/1959 Baker ..... 92/208
3,035,268 A * 5/1962 Goldring ..... 227/123
3,281,046 A * 10/1966 Boulay ..... 227/115
3,360,176 A * 12/1967 Gehl et al. ..... 227/148
3,542,273 A 11/1970 Hedrick
3,636,707 A * 1/1972 Saari et al. ..... 92/15
3,871,566 A 3/1975 Elliesen
3,895,562 A * 7/1975 El Guindy ..... 91/308
4,117,767 A 10/1978 Elliesen
4,688,710 A * 8/1987 Massari et al. ..... 227/109
4,907,730 A 3/1990 Dion
5,251,367 A * 10/1993 Ward et al. ..... 29/81.15
5,547,448 A * 8/1996 Robertson ..... 492/16
(Continued)

FOREIGN PATENT DOCUMENTS

CA 2261329 8/1999

*Primary Examiner* — Lindsay Low
(74) *Attorney, Agent, or Firm* — Fraser Clemens Martin & Miller LLC; J. Douglas Miller

(57) ABSTRACT

An actuator housing (20) for use on a pneumatic nailer (10), the actuator housing comprising a casing (22) defining a cartridge insertion opening (24), and a selectively activated actuator cartridge (50) which is inserted in the casing through the cartridge insertion opening. The actuator housing further comprises a releasable second fastening means (30, 69) which allows releasable extraction of the actuator cartridge from the casing. The actuator cartridge comprises an actuator head (54) for sealing engagement with the cartridge insertion opening of the casing and extending outwardly of the casing. The actuator cartridge also comprises a piston assembly (58) received within the casing, the piston assembly comprising a cylinder (100) defining a cylinder chamber (101) therein and a plunger (120) movably mounted within the cylinder chamber. The actuator cartridge further comprises first fastening means (71, 104) to fasten the actuator head to the cylinder of the piston assembly. Upon selective activation of the actuator cartridge, the plunger is actuated along the cylinder chamber.

17 Claims, 13 Drawing Sheets

U.S. PATENT DOCUMENTS 5,690,267 A 11/1997 Yang
5,909,836 A 6/1999 Shkolnikov et al.
6,061,901 A * 5/2000 Tanaka ..... 29/798
6,095,392 A 8/2000 Batt, Jr. et al.
6,805,272 B1 10/2004 Sen-Mu et al.
6,834,789 B1 12/2004 Dion
6,837,415 B1 * 1/2005 Huang ..... 227/130
7,213,735 B1 * 5/2007 Ou ..... 227/147
7,278,561 B2 * 10/2007 Schnell et al. ..... 227/130
7,721,817 B2 * 5/2010 McGee et al. ..... 173/37
2004/0238591 A1 12/2004 Kitagawa
2006/0016844 A1 1/2006 Ishizawa

* cited by examiner

ACTUATOR HOUSING HAVING A RELEASABLE ACTUATOR CARTRIDGE FOR USE ON HARDWOOD FLOORING PNEUMATIC NAILERS

FIELD OF THE INVENTION

The present invention relates to pneumatic nailers, and more particularly to an actuator housing having a releasable actuator cartridge for use on a pneumatic nailer.

BACKGROUND OF THE INVENTION

Hardwood flooring generally consists of a number of juxtaposed elongated tongue-and-groove planks interlocked with each other, and then fastened in position to a subjacent subfloor. To fasten these hardwood planks to the subfloor of a room (composed for example of plywood plates and/or floor joists), it is known to use a dedicated pneumatic nailer. A pneumatic nailer for hardwood flooring generally comprises a main body carrying a floor-engageable shoe mounted to its bottom surface, upon which the nailer rests against a hardwood plank prior to discharging a fastener in the latter.

The pneumatic nailer also comprises an actuator housing on the nailer's main body and connected to a pressurized air source (e.g. an air compressor). The actuator housing has a casing defining a pressurized air chamber therein, the casing carrying a fastener discharge mechanism comprising an actuator head and a piston assembly. The piston assembly comprises a cylinder defining a cylinder chamber, and a plunger mounted inside the cylinder chamber and movable therein between upper and lower limit positions. The plunger in turn comprises a head portion engaging the inner peripheral wall of the cylinder in airtight fashion, and a striking rod carried by the plunger head.

Moreover, a magazine is mounted to the nailer and serially feeds fasteners, in the form of metallic L- or T-shaped barbed cleats or staples, into a fastener ejection channel defined by the actuator housing.

At rest, a valve of the actuator head is positioned in a closed position, in which it cuts off fluid communication between the upper portion of the piston's cylinder chamber (the portion located above the plunger head) and the pressurized air chamber. To set off a fastener discharge cycle of the nailer, a workman activates a trigger thereof, which causes the valve to shift to its open position and to enable air to be admitted in the piston's cylinder above of the plunger head, which causes the plunger to move with great force and celerity from its upper limit position to its bottom limit position. As the plunger travels from its upper to its bottom limit position, the striking rod thereof sweeps the fastener ejection channel containing a fastener. The fastener is consequently forced out of the nailer and driven into the subjacent workpiece.

On certain nailers, the fastener discharge cycle is set off by striking an impact-receiving actuator head with a mallet; on other types of nailers, the fastener discharge cycle is set off when the user pushes a switch on the pneumatic nailer.

Such nailers are designed to have an extended longevity, and the internal components of the actuator housing of such nailers need to be maintained at regular intervals during their extended lifetime in order to remain in functioning condition. More particularly, the fastener discharge mechanism—composed of an intricate arrangement of movable parts—needs to be regularly accessed in order to be cleaned, lubricated, repaired or generally maintained.

In prior art devices, performing maintenance tasks on the fastener discharge mechanism can be tedious, and even problematic if the appropriate tools are not handy, as some of the parts of the fastener discharge mechanism cannot be accessed without disassembling and opening up the casing.

SUMMARY OF THE INVENTION

The present invention relates to an actuator housing for use on a pneumatic nailer, said actuator housing comprising:

- a casing, at least partially hollow, defining a cartridge insertion opening;
- a selectively activated actuator cartridge which can be inserted in said casing through said cartridge insertion opening, said actuator cartridge comprising:
  - an actuator head for sealing engagement with said cartridge insertion opening of said casing, said actuator head extending at least partially outwardly of said casing,
  - a piston assembly received at least partially within said casing, said piston assembly comprising a tubular member defining a chamber therein and a plunger at least partially movably mounted within said chamber;
  - first fastening means fastening said actuator head to said tubular member of said piston assembly; and
- releasable second fastening means, allowing releasable fastening of said actuator cartridge to said casing;

wherein upon selective activation of said actuator cartridge, said plunger is actuated along said cylinder chamber for striking a fastener, and wherein said second fastening means can be released to disconnect said actuator cartridge from said casing.

In one embodiment, said releasable second fastening means connects said actuator head to said casing.

In one embodiment, said first fastening means are releasable.

In one embodiment, said tubular member is a cylinder, and said tubular member chamber is a cylinder chamber.

In one embodiment, said second fastening means comprise an annular threaded section of said actuator head and an annular threaded section of said cartridge insertion opening, to allow said actuator head to be screwed into said cartridge insertion opening.

In one embodiment, said actuator head defines an inner portion extending within said casing, said first fastening means are defined by an annular threaded section of said actuator head inner portion and an annular threaded section of said cylinder, to allow said actuator head inner portion and said cylinder to be screwed together.

In one embodiment, said threaded sections of said first fastening means define a first thread pitch, and said threaded sections of said second fastening means define a second thread pitch greater than said first thread pitch, wherein the difference between said first and second thread pitches provides for a number of turns required to release said first fastening means greater than the number of turns required to release said second fastening means.

In one embodiment, said actuator head inner portion defines air inlets made therethrough.

In one embodiment, said casing defines a striking member opening, and said plunger carries a striking member engageable in said striking member opening, said striking member being for striking fasteners.

In one embodiment, said plunger comprises a plunger head carrying said striking member, said plunger head being slidably movable within said tubular member chamber between a first limit position and a second limit position.

In one embodiment, said casing comprises a guiding piece defining a slit therethrough, said guiding piece slit forming said striking member opening.

In one embodiment, said casing defines a pressurized main chamber, and said actuator cartridge further comprises a valve. When said actuator cartridge is at rest, said valve is closed and fluid communication between said pressurized main chamber and a portion of said tubular member chamber above said plunger is prevented. Upon activation of said actuator cartridge, said valve opens and fluid communication between said tubular member chamber above said plunger and said pressurized main chamber is established to enable pressurized air to act on said plunger and urge it from a first limit position towards a second limit position.

In one embodiment, said actuator head defines a selectively depressurizable head chamber therein in which said valve is movably mounted, and said tubular member chamber defines an air inlet opening. When said actuator cartridge is at rest, said head chamber is pressurized and said valve is moved towards said tubular member air inlet opening and blocks fluid communication between said tubular member chamber above said plunger and said pressurized main chamber, and when said actuator cartridge is activated, said head chamber is depressurized and said valve is moved away from said tubular member air inlet opening and permits fluid communication between said tubular member chamber above said plunger and said pressurized main chamber.

The present invention also relates to a nailer for driving fasteners, comprising:

- a frame, in turn comprising a casing, said casing being at least partially hollow and defining a cartridge insertion opening and a strike member opening;
- a selectively activated actuator cartridge which can be inserted in said casing through said cartridge insertion opening, said actuator cartridge comprising:
  - an actuator head for sealing engagement with said cartridge insertion opening of said casing, said actuator head extending at least partially outwardly of said casing,
  - a strike motion assembly received at least partially within said casing, said strike motion assembly comprising a chamber member having a wall circumscribing a chamber member enclosure, a strike member mounted to said chamber member, said strike member having a portion engageable in said strike member opening, said strike member for striking and ejecting loose fasteners; and a means for mounting said strike member to said chamber member for relative movement of said striking portion into said chamber member enclosure;
  - first fastening means fastening said actuator head to said chamber member of said piston assembly; and
- releasable second fastening means, allowing releasable fastening of said actuator cartridge to said casing;
- a fastener receiving member, for receiving loose fasteners to be driven outwardly of said nailer;

wherein upon selective activation of said actuator cartridge, said strike member is actuated along said chamber member, and wherein said second fastening means can be released to disconnect said actuator cartridge from said casing.

In one embodiment, said strike motion assembly consists of a piston assembly, said chamber member comprises a cylinder, and said strike member is a plunger movably mounted in reciprocating fashion within said cylinder.

DETAILED DESCRIPTION OF THE EMBODIMENTS

Figure 1:
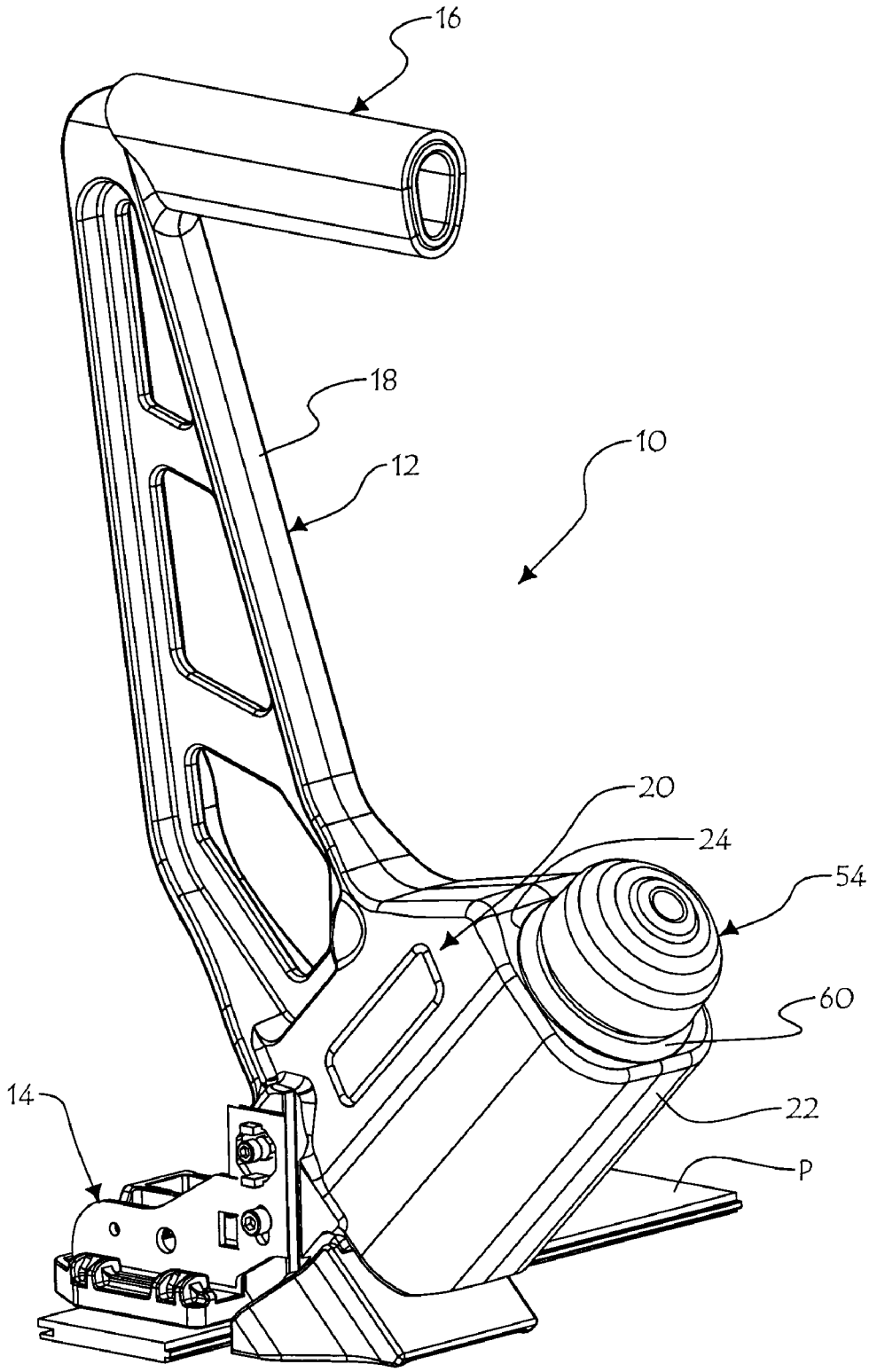
FIG. 1 is a front perspective view of a hardwood flooring nailer, comprising a mallet-operated actuator housing according to one embodiment of the present invention.

FIG. 1 shows a pneumatic nailer 10. The illustrated nailer 10 is of the type used to secure hardwood flooring planks to a subfloor. It is however understood that the present invention could extend to any kind of pneumatic fastener driving tool.

Nailer 10 comprises a C-shaped frame 12, made of moulded metal for example, carrying a shoe 14 at its bottom end portion. Shoe 14 will rest on a subjacent workpiece, such as a tongue-and-groove hardwood plank P, prior to driving a fastener therein.

C-shaped frame 12 defines a handle portion 16 integrally carried at one end of an arm portion 18 and extending transversally relative thereto. Arm portion 18 also integrally carries an actuator housing 20 according to the present invention, at its end opposite handle portion 16.

Figure 2:
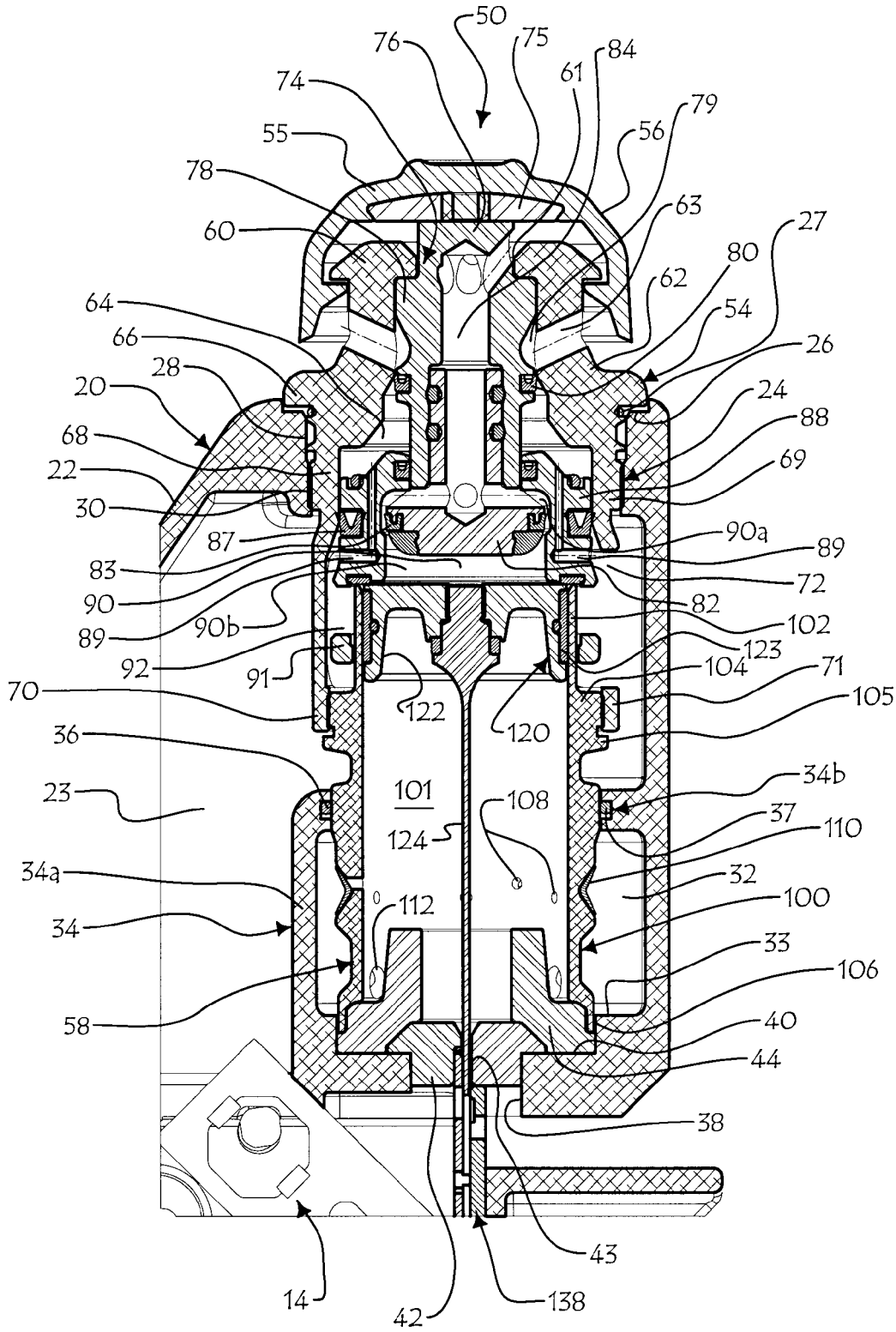
FIGS. 2-7 are partial sectional elevations of the actuator housing of FIG. 1, and show the sequential movement of the components of the actuator cartridge during a fastener discharge cycle of the nailer.

Actuator housing 20 is best shown in FIGS. 2-9, although its internal components are only thoroughly numbered in FIG. 2. Actuator housing 20 comprises a hollow casing 22, in turn defining a main chamber 23 therein. Main chamber 23, even though it is shown confined within casing 22, could further extend into other portions of frame 12 (arm portion 18 and handle portion 16).

In the illustrated embodiment, casing 22 is a moulded section of frame 12. In another embodiment, casing 22 could be distinct from frame 12 and bolted thereto instead of being a moulded section thereof, as shown for example in U.S. Pat. No. 6,834,789 (from inventors Dion et al.).

Figure 9:
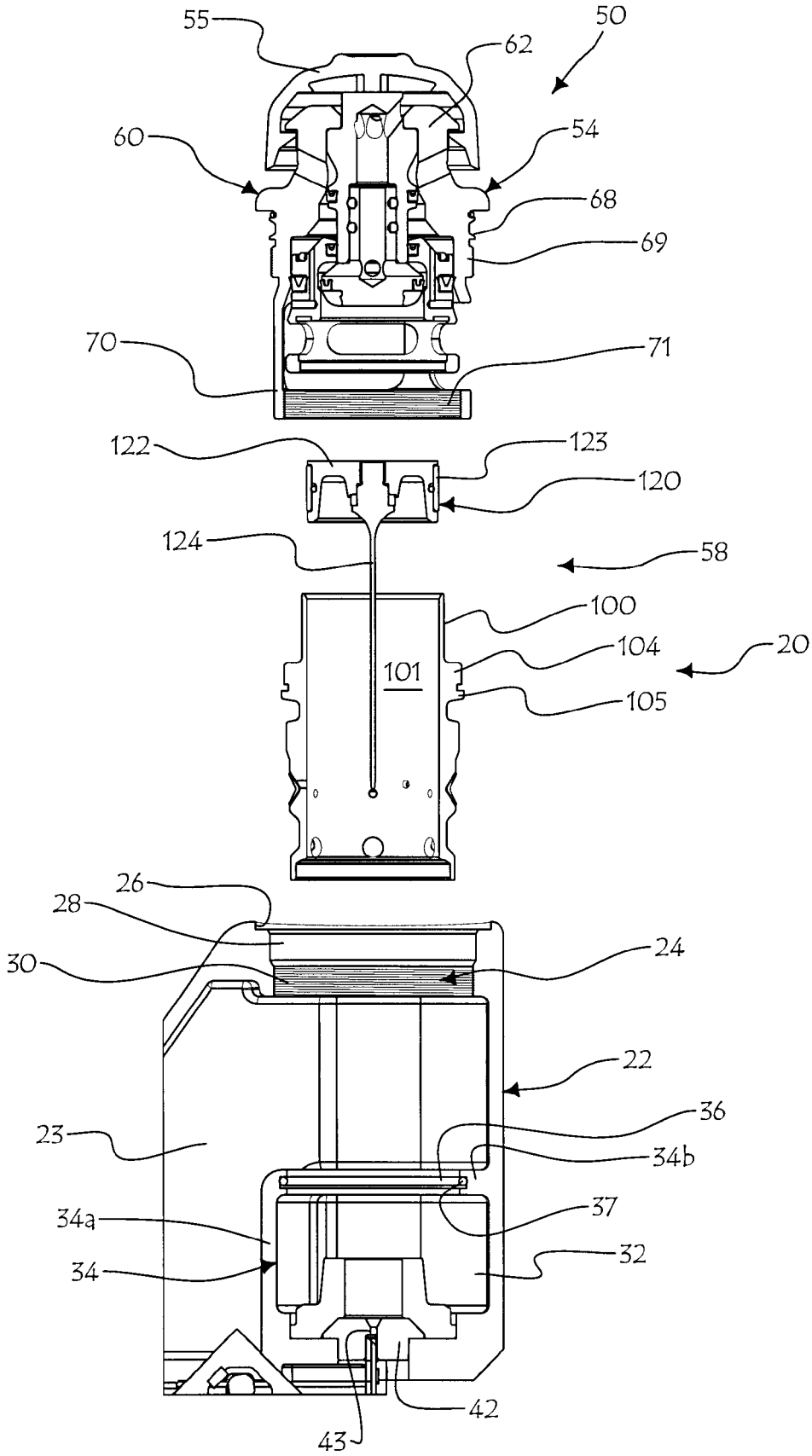
FIG. 9 is a view similar to FIG. 8 but showing the actuator head disconnected from the piston assembly, and the plunger of the piston assembly extracted out of the cylinder of same.

A compressed air source (not shown) feeds compressed air into main chamber 23 through the instrumentality of a hose (not shown) connected to a conventional compressed air inlet (not shown) made through casing 22 and opening into main chamber 23. Casing 22 further comprises a cartridge insertion opening 24 made in the casing's upper wall. As best seen in FIG. 9, opening 24 can be decomposed in three tiers: (1) an outermost annular depression 26 recessed in the outer surface of casing 22; (2) a cylindrical intermediate portion 28 juxtaposed to and diametrically smaller than annular depression 26; and (3) a cylindrical innermost threaded portion 30, opening into the hollow of casing 22.

Main chamber 23 within casing 22 is separated from an auxiliary chamber 32 by a moulded partition 34. Partition 34 defines an upright wall 34*a* extending upwardly from the internal bottom wall of casing 22, and a top wall 34*b* transversal to upright wall 34*a* and having a circular cylinder insertion opening 36 made therethrough, coaxial to the circular cartridge insertion opening 24. Cylinder insertion opening 36 is lined with sealing means in the form of a rubber O-ring 37.

Moreover, a circular bottom opening 38 and an annular shoulder 40 just above bottom opening 38, are made on a bottom wall 33 of auxiliary chamber 32. Casing 22 comprises a mushroom-shaped guiding piece 42, a bottom portion of which is snugly inserted in casing bottom opening 38, and a relatively larger head portion thereof abutting on shoulder 40. Guiding piece 42 defines a central slit 43, for sliding engagement by a striking rod 124 of actuator cartridge 50. In addition, within auxiliary chamber 32 is provided a shock absorber 44 snugly received in annular shoulder 40 and resting against guiding piece 42.

Just beneath guiding piece 42 is provided a fastener receiving assembly 138 (best shown in FIG. 11), formed of a bolted assembly of two plates 140 and 142 affixed to frame 12. Plate 140 defines a fastener-shaped opening 144 therein, and plates 140, 142 comprise registering grooves which form in combination a longitudinal fastener striking channel 146 extending edge-to-edge across plate assembly 138. Fastener striking channel 146 is axially aligned with the longitudinal axis of guiding piece slit 43 and of striking rod 124, and opens at a fastener ejection opening 148. Fastener striking channel 146, as described hereafter, will be forcibly swept by striking rod 124.

Nailer 10 can also be provided with a fastener feeder in the form of an elongated magazine (not shown) affixed to frame 12. The magazine is for holding a supply of fasteners (not shown), e.g. a strip of metallic staples or L- or T-shaped barb-provided cleats commonly used in floor assembling duties, and for loading them serially into fastener striking channel 146 through fastener-shaped opening 144 in plate 140. A fastener loaded in channel 146 when the latter is swept by striking rod will be struck and thereby and forcibly ejected of the nailer through fastener ejection opening 148.

An actuator cartridge 50 according to a first embodiment of the present invention is shown in FIGS. 2-10. Actuator cartridge 50 is partially inserted in casing 22 and is connected thereto, and is integrally releasable therefrom, as described hereinafter.

Actuator cartridge 50 is received in casing 22 through cartridge insertion opening 24. Actuator cartridge 50 comprises an actuator head 54 releasably secured to a piston assembly 58. A protective plastic cap 55 is snap-fitted on actuator head 54.

Figure 10:
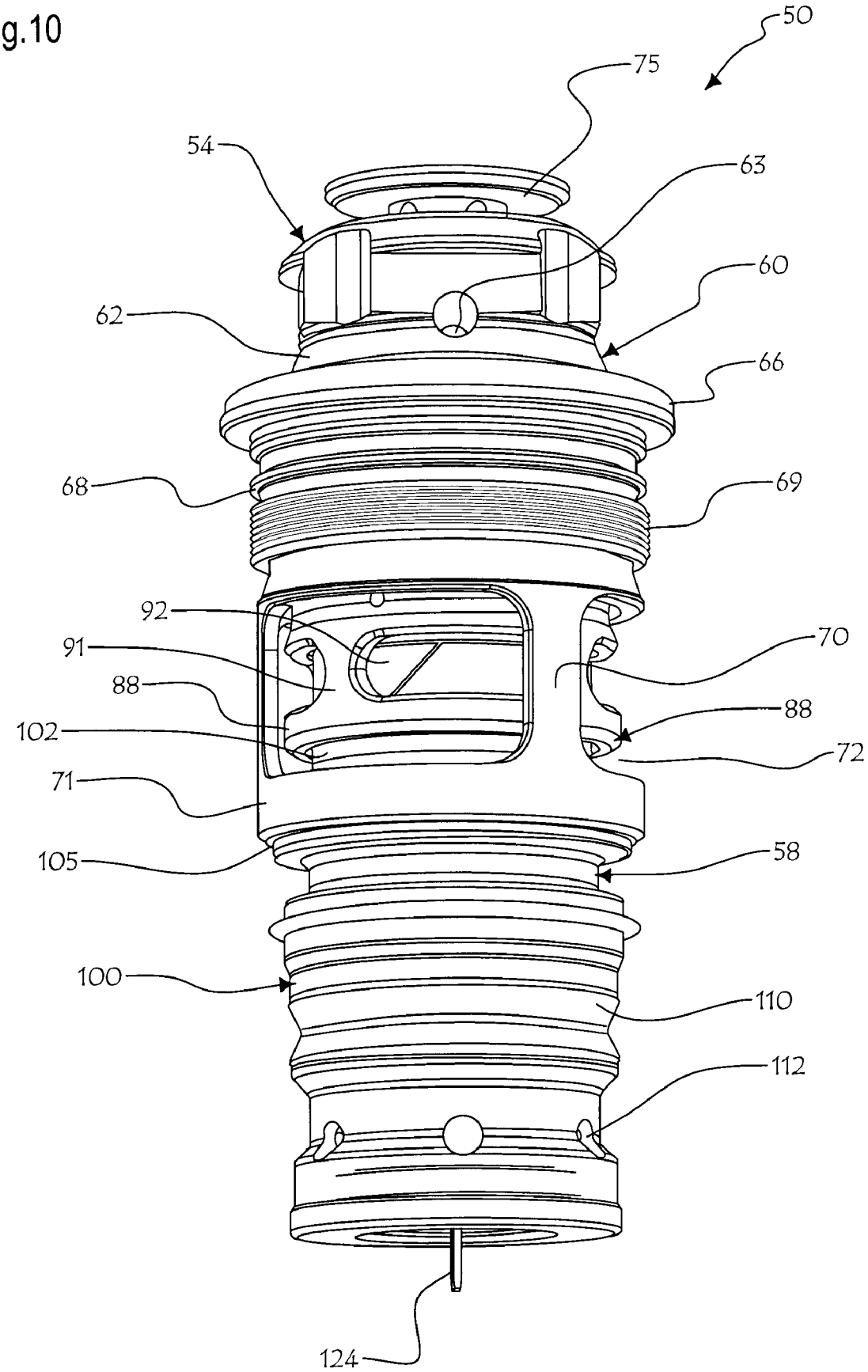
FIG. 10 is an enlarged perspective view of the actuator cartridge of the previous figures.
Figure 12A:
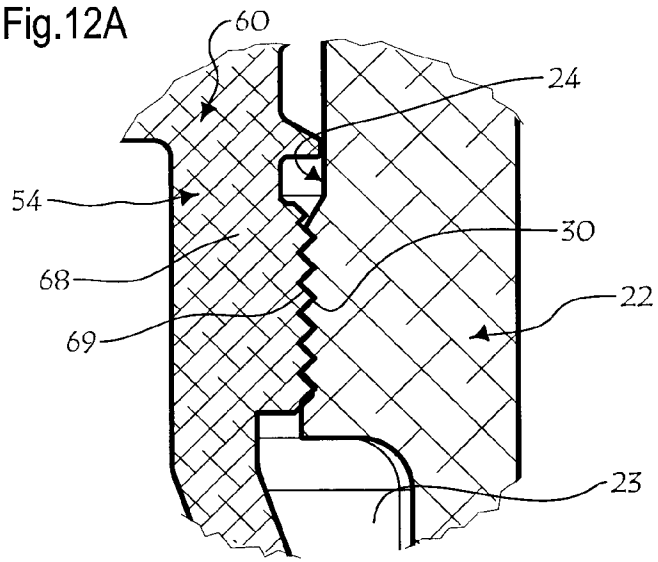
FIGS. 12A and 12B are enlarged partial sectional elevations substantially circumscribed within double-pointed arrows 12A and 12B respectively in FIG. 3, respectively showing the threading engagement of the actuator head in the casing opening, and the threading engagement of actuator head with the piston assembly cylinder.

Actuator head 54 comprises a rigid metallic shell 60 screwed and thus releasably connected to cartridge insertion opening 24, as best seen in FIG. 12A. Back to FIG. 2, shell 60 is partially hollow and defines a head chamber 64 therein, which opens at opening 61 made across the top wall of shell 60. Shell 60 also defines an outer portion 62 extending outwardly of casing 22, which in turn defines an annular flange 66, received in depression 26 of casing 22. Outer shell portion 62, beneath flange 66, integrally merges with an intermediate shell portion 68. An O-ring 27 located at the junction between shell outer portion 62 and intermediate portion 68 ensures airtight interconnection of actuator head 54 and casing 22. Intermediate shell portion 68 is received in cartridge insertion opening 24, and a lower section 69 of intermediate shell portion 68 is peripherally threaded and can threadingly engage threaded portion 30 of cartridge insertion opening 24. From intermediate shell portion 68 integrally downwardly depends an inner portion, or skirt portion 70. Skirt portion 70, as best shown in FIG. 10, is cylindrical and extends within casing 22 towards piston assembly 58. Skirt portion 70 defines a number of wide, peripherally spaced-apart air inlet windows 72 made therethrough. The lower rim 71 of skirt portion 70 has a threaded inner wall, and can be screwed on a correspondingly threaded annular projection 104 on a piston assembly cylinder 100, as further described below.

A number of movable components are nested within actuator head 64. A barrel member 74 is slidably received in head chamber 64. Barrel member 74 comprises an upper stub portion 76 extending and projecting outwardly of top opening 61 made in shell 60. Upper stub portion 76 carries a discoid impact plate 75 at its outer free end, which in turn abuts on the inner surface of protective plastic cap 55. At its end opposite impact plate 75, stub portion 76 merges with a cylindrical and tubular elongated sliding portion 78. Sliding portion 78 is sized to freely and slidably engage the upper, correspondingly cylindrical portion of head chamber 64. An annular depression 79 is made peripherally on the outer peripheral wall of sliding portion 78. Beneath this depression, sliding portion 78 carries annular sealing means in the form of a rubber U-cup 80. Furthermore, opposite stub portion 76, sliding portion 78 carries a widened, discoid head portion 82. In one embodiment, head portion 82 is releasable from sliding portion 74. Around head portion 82 is wrapped an annular sealing means in the form of a U-cup 83.

An air exhaust channel 84 extends across barrel member 74. Exhaust channel opens at the junction between head portion 82 and sliding portion 78, extends longitudinally along sliding portion 78, and opens into the atmosphere through a slanted opening made in stub portion 76.

Moreover, a cylindroid valve 88 is movably slidably received in head chamber 64, and a U-cup 87 permits airtight engagement of the outer peripheral wall of valve 88 on the inner peripheral wall of head chamber 64 in all positions of valve 88. Compressed air is thus never allowed to flow from main chamber 23 into head chamber 64 by seeping through the interstice formed between the outer wall of valve 88 and the peripheral wall of head chamber 64. Valve 88 is carried at the lower end portion of barrel member 74 coaxially thereto, and head portion 82 of barrel member 74 occupies a valve chamber 90 within valve 88. Valve chamber 90 is cross-sectionally circular, and defines an upper portion 90*a* diametrically larger than a lower portion 90*b* thereof. Moreover, valve 88 defines a downwardly depending skirt portion 91, through which are made elongated, peripherally spaced apart air inlets 92 (FIG. 10). Valve 88 further comprises a number of L-shaped air channels 89, opening on one end in main chamber 23, and at the other end in head chamber 64.

As can be seen in the figures, movable valve 88 is at least partially surrounded by skirt 70 of actuator head shell 60. Therefore, to prevent shell skirt 70 to interfere with the movement of valve 88, the outer diameter of valve 88 is smaller than the inner diameter of shell skirt portion 70.

As briefly mentioned above, actuator head 54 is releasably connected to a piston assembly 58. Piston assembly 58 comprises a tubular member in the form of cylinder 100, in which is slidably mounted a plunger 120 for reciprocating movement therein. Cylinder 100 defines a cylinder chamber 101 therein.

Figure 12B:
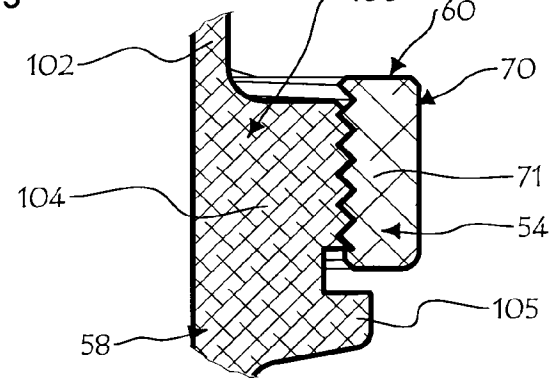

Cylinder 100 defines an upper rim portion 102 circumscribing a top opening of the cylinder chamber. Skirt portion 91 of valve 88 is slidably wrapped around upper rim portion 102. Moreover, cylinder 100 integrally defines a radially projecting annular portion 104 having a peripherally threaded outer surface; annular portion 104 is diametrically wider than the adjacent upper rim portion 102. The skirt lower rim 71 of actuator head shell 60, whose inner surface is threaded, is screwed to annular threaded portion 104, and actuator head 54 and piston assembly 58 are thereby interconnected in a releasable fashion, as best seen in FIG. 12B.

Back to FIG. 2, a lower end portion of cylinder 100 is received in auxiliary chamber 32 of casing 22 through circular cylinder opening 36 made in partition top wall 34*b*. The outer surface of cylinder 100 engages seal 37 peripherally lining cylinder opening 36, ensuring an airtight connection therebetween. The lower rim 106 of cylinder 100 is snugly received in airtight fashion in a gap formed between shock absorber 44 and shoulder 40 made on auxiliary chamber bottom wall 33, and shock absorber 44 partly extends into cylinder chamber 101.

Moreover, a number of exhaust holes 108 are made through cylinder 100, which are unidirectionally obstructed by an elastic band 110 engaged in a cross-sectionally V-shaped annular and peripheral groove made on the external surface cylinder 100. Exhaust holes 108 allow unidirectional radially outward air flow between cylinder chamber 101 and auxiliary chamber 32: air can flow from cylinder chamber 101 towards auxiliary chamber 32 through exhaust holes 108 by deformingly biasing elastic band 110 radially outwardly and by seeping between elastic band 110 and cylinder's outer surface. However, air is prevented from flowing in the opposite, radially inward direction since the elastic band 110 obstructs exhaust holes 108. Furthermore, relative larger unobstructed transfer holes 112 are made below exhaust holes 108, adjacent the lower rim of the cylinder.

As mentioned above, a plunger 120 is slidably mounted within cylinder 100. As bet seen in FIGS. 2 and 9, plunger 120 defines a discoid plunger head 122, whose peripheral wall slidably engages in the inner peripheral wall of cylinder 100. The slidable engagement of plunger head 122 on the inner peripheral wall of cylinder 100 is kept airtight by a peripheral sealing band 123. Furthermore, the shape of the undersurface of plunger head 122 is made complementary to the shape of shock absorber 44.

Figure 11:
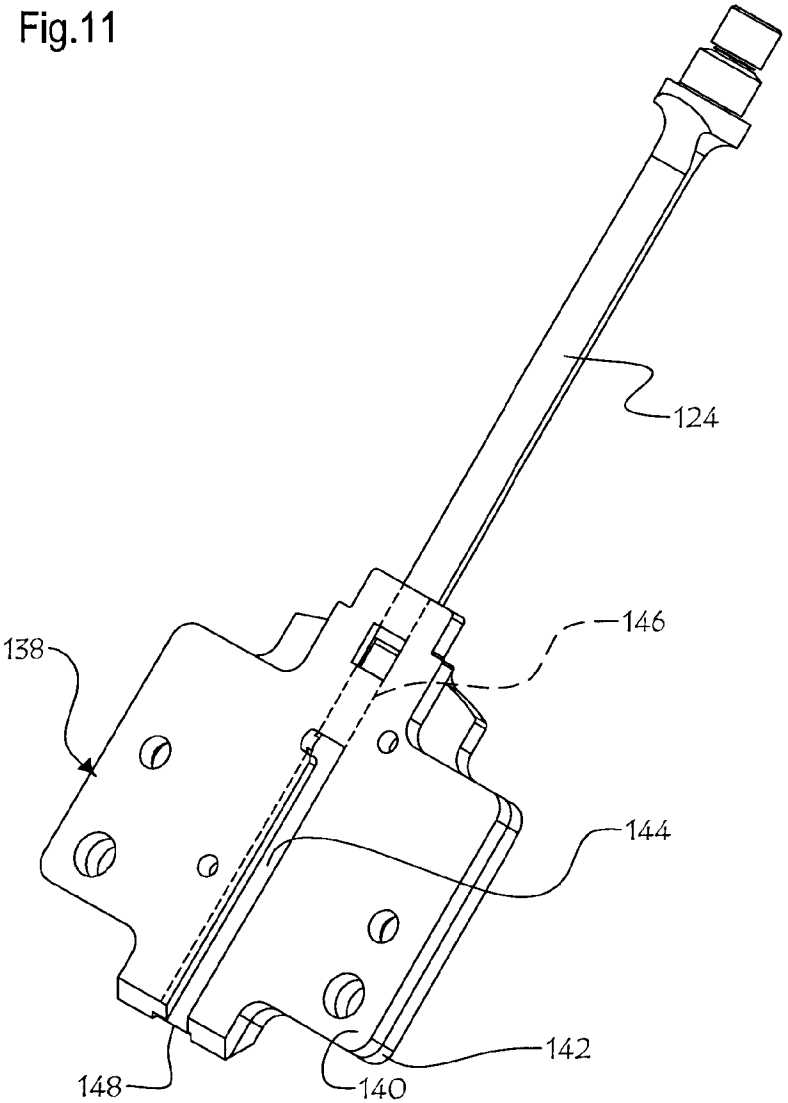
FIG. 11 is an enlarged perspective view of the striking rod and of the fastener receiving assembly.

The undersurface of plunger head 122 centrally carries a cross-sectionally rectangular striking rod 124 (see FIG. 11). Striking rod 124 extends through the central opening of shock absorber 44, and slidably engages central slit 43 in guiding piece 42. As plunger 120 moves downwardly into cylinder chamber 101, striking rod 124 will axially sweep fastener ejection channel 146 in plate assembly 138, in which fasteners are destined to be loaded, as mentioned above.

For more elaborate details concerning the actuator housing and its internal components described above, it is possible to consult U.S. Pat. No. 6,834,789 (from inventors Dion et al.), which describes a similar actuator housing. It is to be noted that U.S. Pat. No. 6,834,789 however does not disclose an actuator cartridge releasable "as one" from the actuator casing. It rather discloses an actuator head separate unconnected to and distant from the piston assembly. The piston cylinder in U.S. Pat. No. 6,834,789 is permanently affixed to the casing.

To use the nailer, actuator cartridge 50 must be properly assembled and properly secured to casing 22. More particularly, actuator head 54 must be properly secured to piston assembly 58 by maximum screwing of shell skirt lower rim 71 onto annular threaded portion 104 of piston cylinder 100. Skirt rim 71 should firmly abut against a stopper ring 105 projecting integrally radially from the outer surface of cylinder 100 and located beneath annular threaded portion 104. Moreover, actuator cartridge 50 must be suitably secured to casing 22 by maximal screwing of actuator head 54 in cartridge insertion opening 24, by meshing the threaded section 69 of shell intermediate portion 68 in threaded portion 30 of cartridge insertion opening 24. Shell annular flange 66 should be firmly pressed against annular depression 26 provided around opening 24.

In order to use nailer 10, a compressed air source must be operatively connected to casing 22, and must be activated in order to feed compressed air into main chamber 23 and keep the latter pressurized.

A workman starts by suitably positioning nailer shoe 14 above a workpiece to be nailed. Then, to trigger the nailer, the workman must forcibly pound actuator head 54 using a mallet for example.

At rest, all components of the nailer are positioned as shown in FIG. 2. In this configuration:

- barrel member 74 is moved to an upper limit position, and impact plate 75 is spaced away from the upper surface of actuator head shell 60. In this upper limit position of barrel member 74, U-cup 80 of sliding portion 78 sealing engages the inner wall of head chamber 64. This sealing engagement prevents air located into head chamber 64 to be exhausted out of head chamber 64 through slanted openings 63 made in shell 60, opening into head chamber 64 at one end and outwardly of shell 60 into the atmosphere at the other end. In this position of barrel member 74, fluid communication between head chamber 64 and the atmosphere is thus blocked;
- plunger 120 is moved to its upper limit position, and the top surface of plunger head 122 is at the same level than the top circular edge of cylinder rim portion 102. In this upper limit position, striking rod 124 substantially clears fastener striking channel 144;
- valve 88 is moved towards cylinder outer rim portion 102 and sealing engages its upper free edge. In this configuration, the air inlets 92 on the side of valve skirt 91 are completely covered and obstructed by the outer peripheral surface of cylinder rim 102, and fluid communication between the pressurized main chamber 23 and the top opening of cylinder 100 is blocked. Moreover, the relative position of barrel member head portion 82 and valve 88 is such that head portion U-cup 83 clears the peripheral wall of valve chamber 90. Thus, the entirety of valve chamber 90 communicates with the atmosphere through exhaust channel 84, and atmospheric pressure is applied to the top surface of plunger head 122. Moreover, in this position, air channels 89 are unobstructed and allow pressurized air to flow from pressurized main chamber 23 into head chamber 64.

Figure 3:
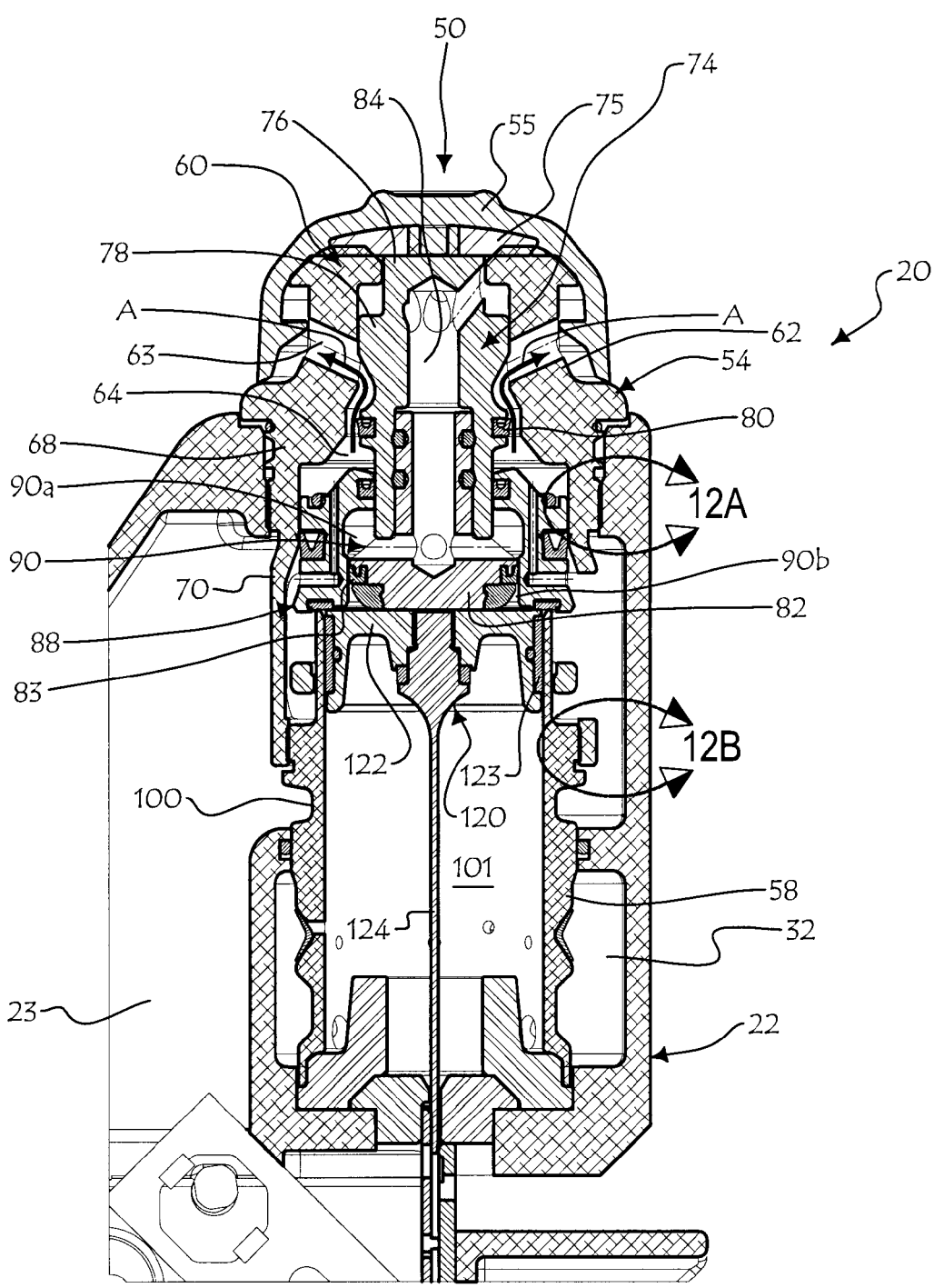

When a workman strikes actuator head 54 with a mallet or any other heavy tool, impact plate 75 is forced downwardly until it abuts against the upper surface shell 60, as shown in FIG. 3. Barrel member 74 is thereby axially moved downwardly along with impact plate 75, which causes U-cup 80 to clear the peripheral wall of head chamber 64. This unsealing opens up a passage between head chamber 64 and the atmosphere, and the pressurized air contained in head chamber 64 is evacuated through slanted openings 63 as suggest by arrows A in FIG. 3. The pressure within head chamber 64 thus suddenly drops to atmospheric pressure. The downward motion of barrel member 74 also causes head portion 82 to move within valve inner chamber 90, and U-cup 83 to come in sealing engagement against the peripheral wall of valve chamber lower portion 90*b*. This interrupts fluid communication between the atmosphere and the volume of valve chamber 90 beneath barrel member head portion 82 and above plunger head 122.

Figure 4:
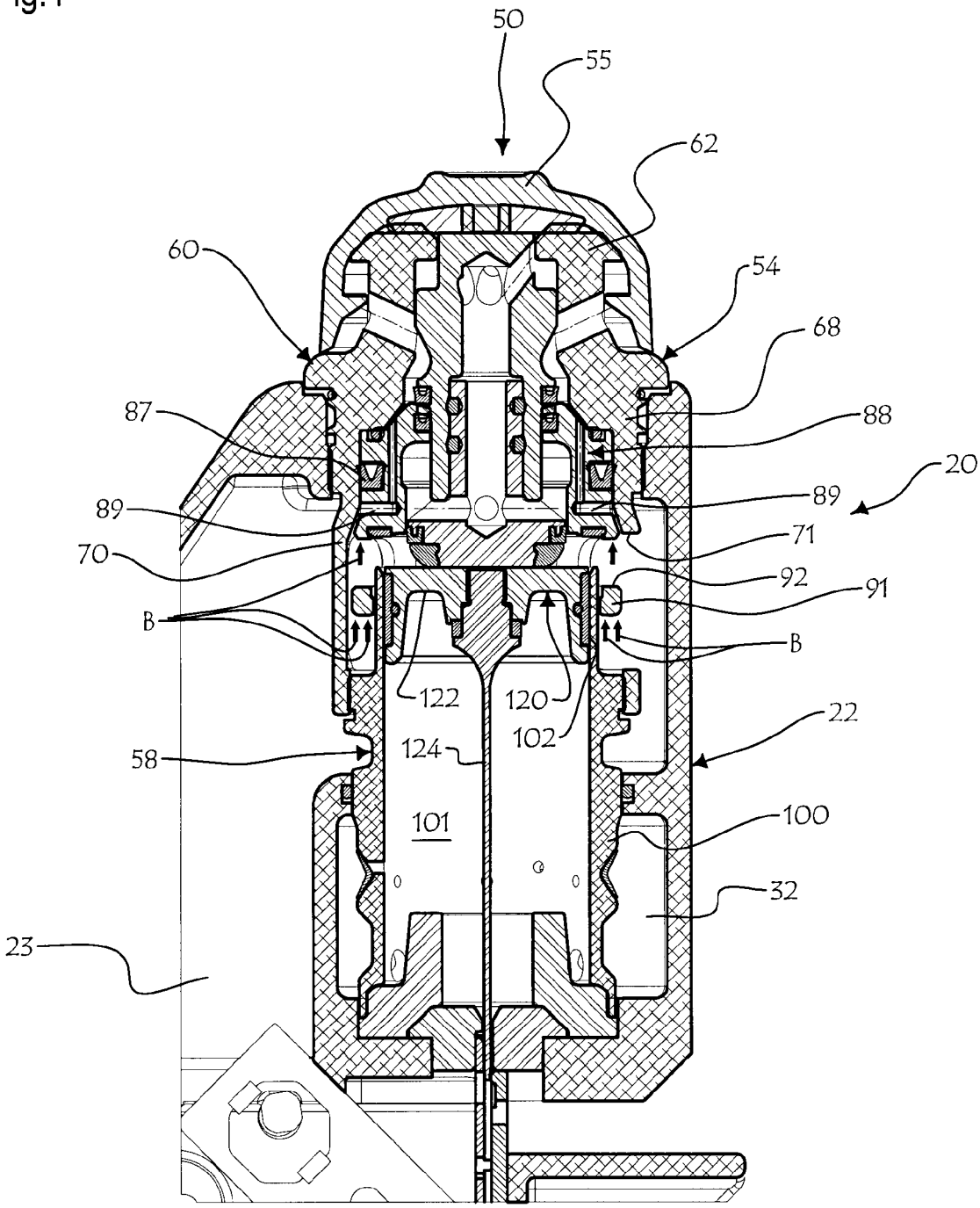

The pressure within head chamber 64 having dropped to atmospheric pressure, the relatively high pressure in main chamber acting upwardly on the horizontal surfaces of valve 88, as suggested by arrows B on FIG. 4, slidably urge valve 88 upwardly. This upward movement of valve 88 causes air channels 89 be become almost completely sealed by the inner peripheral wall of shell skirt 70. Also, as valve 88 moves upwardly, air inlets 92 on valve skirt 90 are cleared by the outer peripheral surface of cylinder rim portion 102, and fluid communication is established between the pressurized main chamber 23 and the portion of cylinder chamber 101 above plunger head 122. Pressurized air in main chamber 23 can thus flow through shell skirt windows 71, through air inlets 92 in valve skirt 91, and into cylinder chamber 101, as suggested by arrows C in FIG. 5. Pressurized air therefore applies a very important downward pressure on the upper surface of plunger head 122 as suggested by arrows C' in FIG. 5, which causes plunger 120 to be urged downwardly. Plunger striking rod 124 concomitantly sweeps the fastener striking channel 146 in plate assembly 138, strikes the fastener loaded therein, ejects it through fastener ejection opening 148 and drives it into the workpiece underlying nailer 10.

Figure 5:
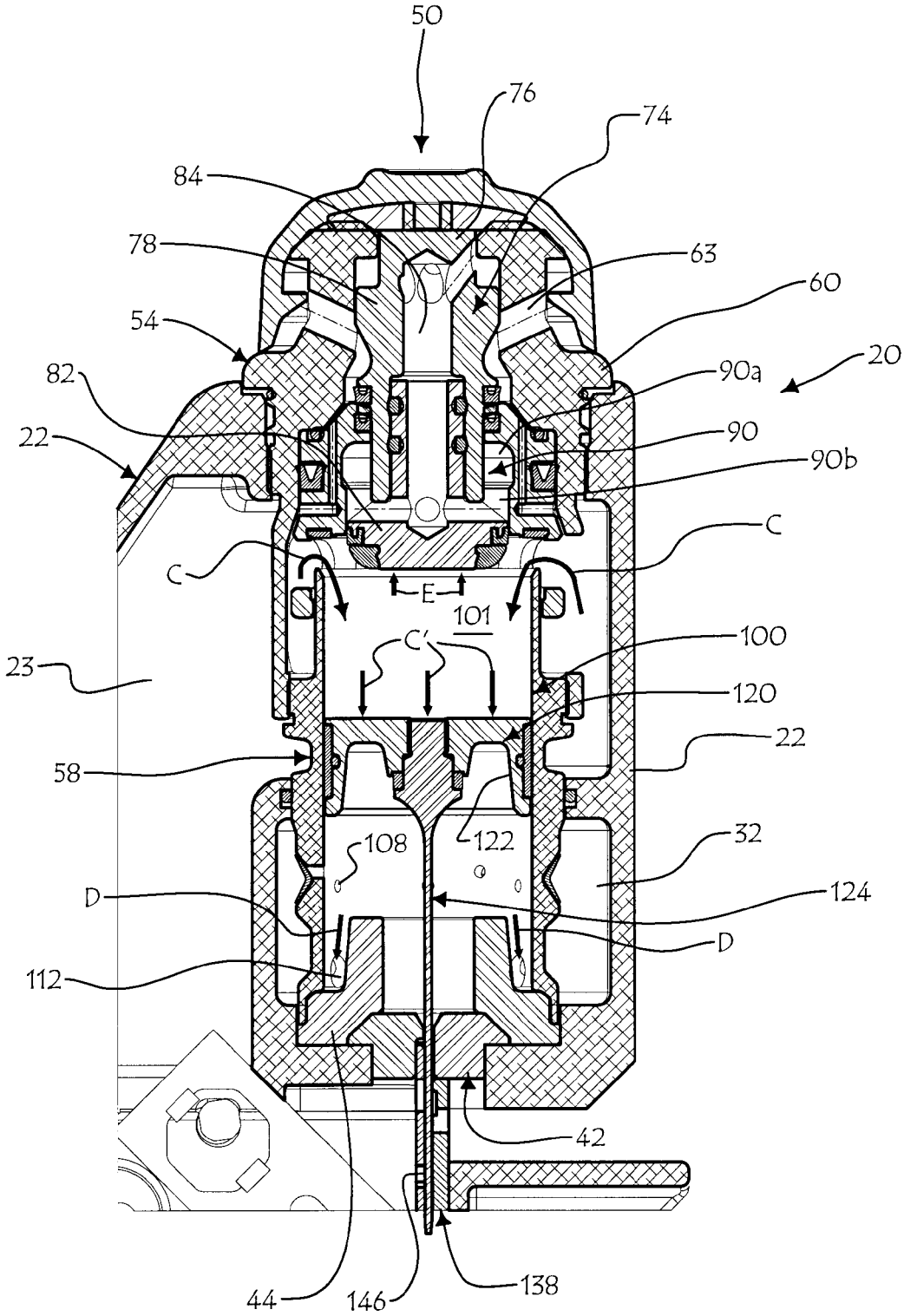

As plunger 120 is urged downwardly, the volume of air in cylinder chamber 101 located beneath plunger head 122 is forced into auxiliary chamber principally through unobstructed transfer holes 112, as suggested by arrows D in FIG. 5.

Figure 6:
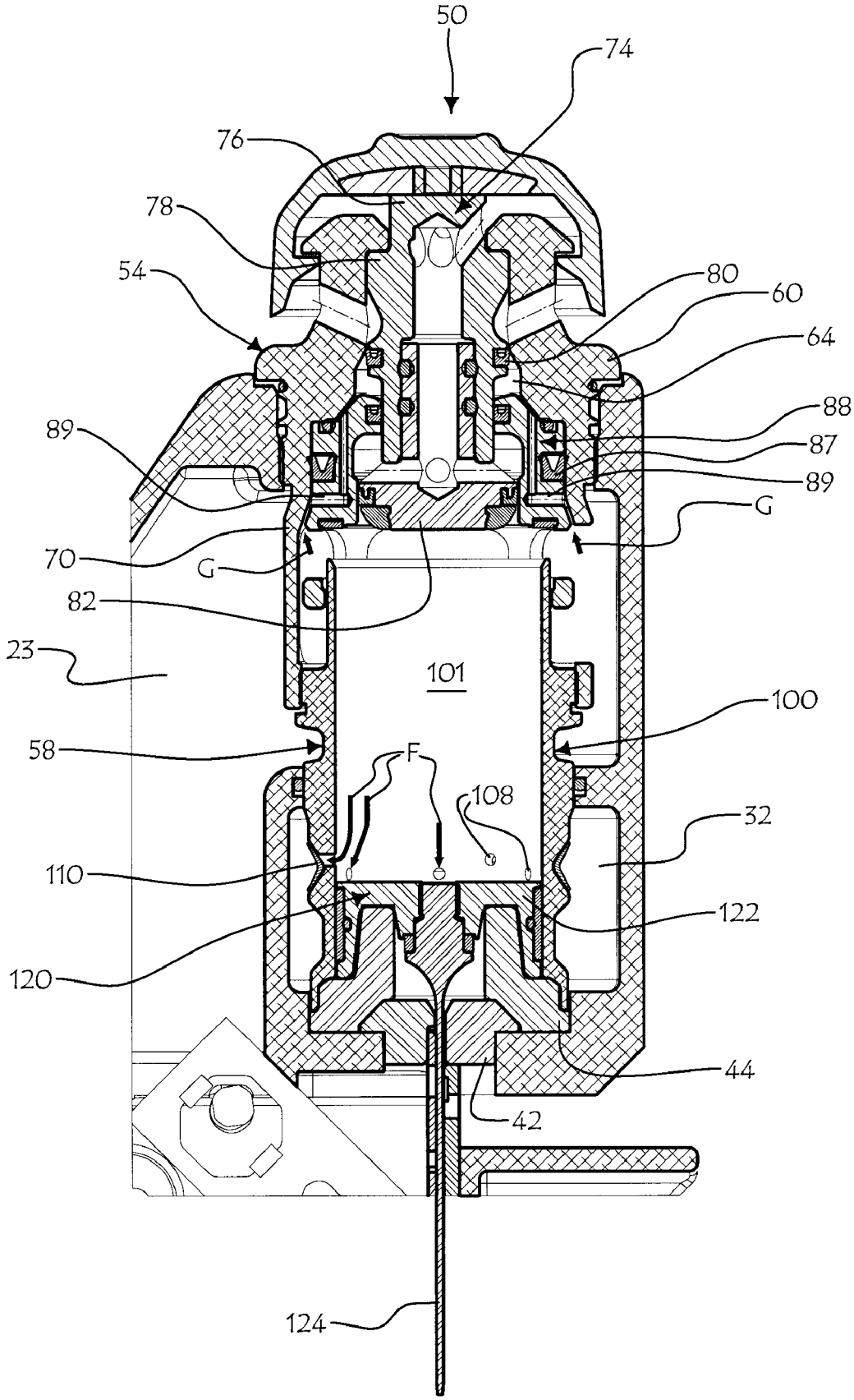

Concomitantly, pressurized air acting on the bottom surface of barrel member head portion 82, as suggested by arrows E in FIG. 5, and eventually causes barrel member 74 to be urged upwardly back to its upper limit position, as shown in FIG. 6. Therefore, U-cup 80 on barrel member sliding portion 78 returns in sealing engagement on the peripheral wall of head chamber 64, and fluid communication between head chamber 64 and the atmosphere through openings 63 is interrupted.

Displacement of plunger 120 is stopped when the undersurface of plunger head 122 impacts and comes in snug engagement against shock absorber 44 (FIG. 6). When plunger 120 is in this lower limit position, cylinder chamber above piston head 122 is still in fluid communication with pressurized main chamber 23, and the upper surface of plunger head 122 is located below and clears unidirectional exhaust holes 108. Therefore, air flows from pressurized cylinder chamber 101 radially outwardly into the relatively low pressure auxiliary chamber 32 through exhaust holes 108 as suggested by arrows F in FIG. 6, and auxiliary chamber 32 becomes substantially pressurized.

Figure 7:
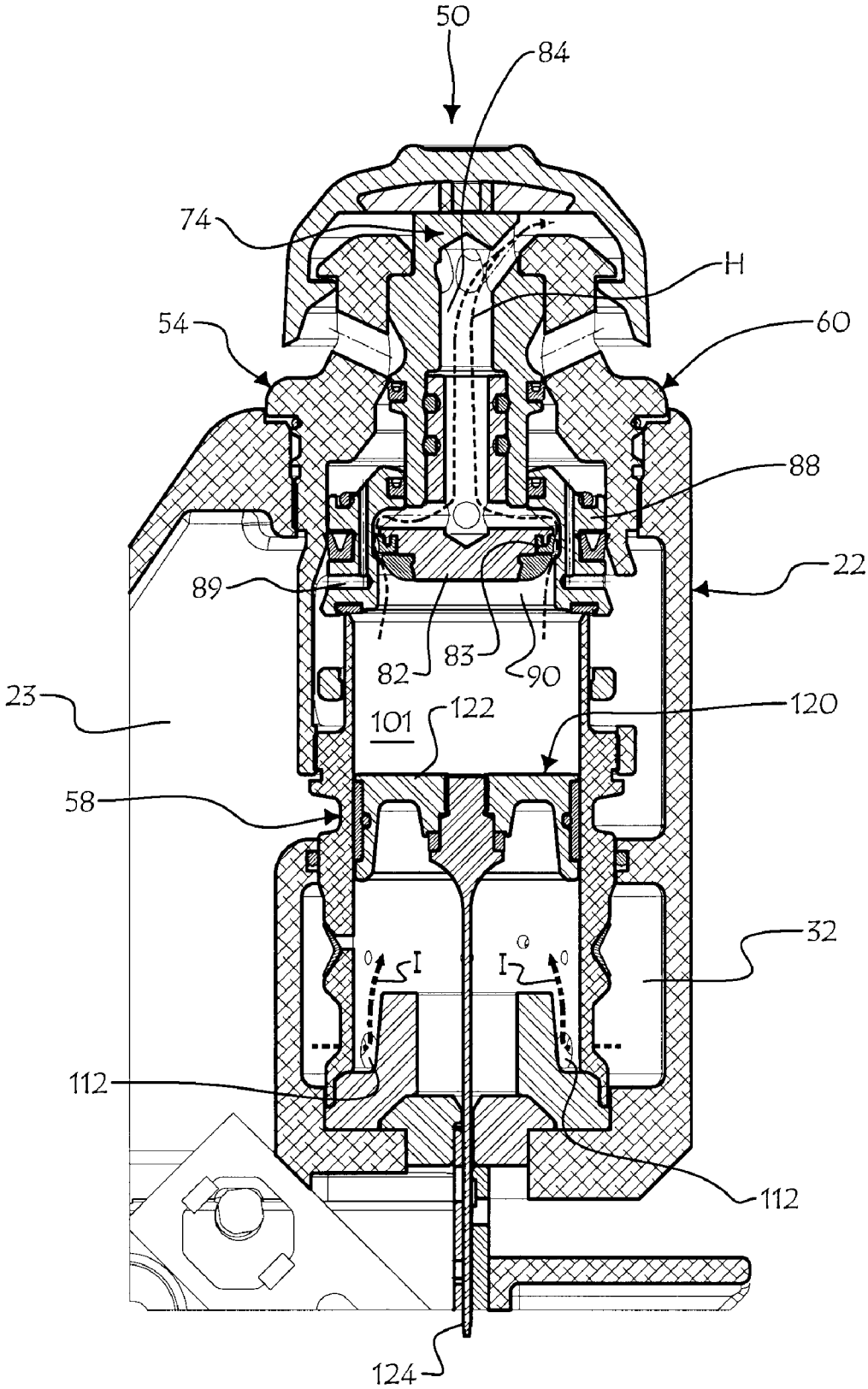

Concomitantly, pressurized air seeps gradually back from main chamber 23 into the sealed head chamber 64 through the not-entirely sealed air channels 89 on valve 88. Indeed, although the end of air channels 89 is almost entirely obstructed and sealed by the inner peripheral wall of shell skirt 70, a very narrow clearance remains therebetween allowing compressed air to flow at a very low rate from main chamber 23 through air channels 89 and into head chamber 64, as suggested by arrows G in FIG. 6. As head chamber 64 slowly but surely pressurizes, valve 88 moves gradually downwardly until air channels 89 are again completely unobstructed by the inner peripheral wall of skirt 71. Once valve 88 has moved sufficiently downwardly so that air channels 89 are cleared by the inner peripheral wall of shell skirt 70, the air flow from main chamber 23 into head chamber 64 is greatly accelerated, head chamber 64 becomes instantly pressurized, and valve 88 is briskly urged downwardly so as to come in pressing and sealing engagement against the upper free edge of piston cylinder 100, as shown in FIG. 7. At this point, fluid communication between cylinder chamber 101 and main chamber 23 is interrupted. Also, in this position of valve 88, the U-cup 83 around barrel member head portion 82 clears the peripheral wall of valve inner chamber 90, and fluid communication between valve chamber 90 and the atmosphere is re-established through exhaust channel 84. Therefore, the pressurized air that remains in cylinder chamber 101 above plunger head 122 thus escapes through the exhaust channel 84 into the atmosphere, as indicated by arrows H in FIG. 7.

At this point, since atmospheric pressure is now applied on the upper surface of plunger head 122, the pressurized air into auxiliary chamber can decompress by flowing back into cylinder chamber 101 beneath plunger head 122 through transfer holes 112 as indicated by arrows I in FIG. 7, thereby urging plunger 120 back towards its upper limit position. The nailer is then ready to start another nailing cycle.

After repeated uses of the nailer, the necessity of performing maintenance tasks on the actuator mechanism becomes advisable and sometimes mandatory. This is greatly facilitated with the present invention. Indeed, an important advantage of the present invention is that the actuator cartridge 50 can be very easily extracted from casing 22, as suggested in FIG. 8-9. Indeed, to perform maintenance tasks on the actuator mechanism, the user can simply grasp actuator head 54 and twist it in the "unscrewing" direction. This causes threads 69 of intermediate portion 68 of actuator head shell 60 to slide against the threads of threaded section 30 of cartridge insertion opening 24, and the connection between actuator head 54 and casing 22 to loosen.

To prevent disconnection of actuator head 54 from piston assembly 58 when the actuator head 54 is unscrewed from casing opening 24, the thread pitch of both threaded interconnections is different. More particularly, the thread pitch of the cooperating threaded sections 69, 30 of actuator head 54 and casing opening 24 respectively, is greater than the thread pitch of the cooperating threaded sections 71, 104 of actuator head 54 and cylinder 100. In practise, this translates in a different number of turns needed for undoing the two threaded interconnections: for example, unscrewing of actuator head 54 from casing opening 24 may necessitate 5 turns, and unscrewing of actuator head 54 from piston assembly 58 may necessitate 10 turns. By providing different thread pitches, actuator head 54 hence cannot be entirely disconnected from piston assembly 58 as actuator head 54 is rotated and unscrewed from casing opening 24.

It is understood that any other suitable technique could be used to prevent disconnection of actuator head 54 from cylinder 100 as actuator head 54 is disconnected from casing 22. For example, a small compressible plastic fitting could be received in a corresponding cavity made in either one of the cooperating threaded sections 104, 71 of cylinder 100 or actuator head 54 respectively. Such a plastic fitting would oppose a certain resistance to the sliding of the threads of actuator head threaded section 71 about those of cylinder threaded section 104, and thus prevent disconnection of cylinder 100 from actuator head 54 as actuator head 54 is unscrewed from casing opening 24.

Figure 8:
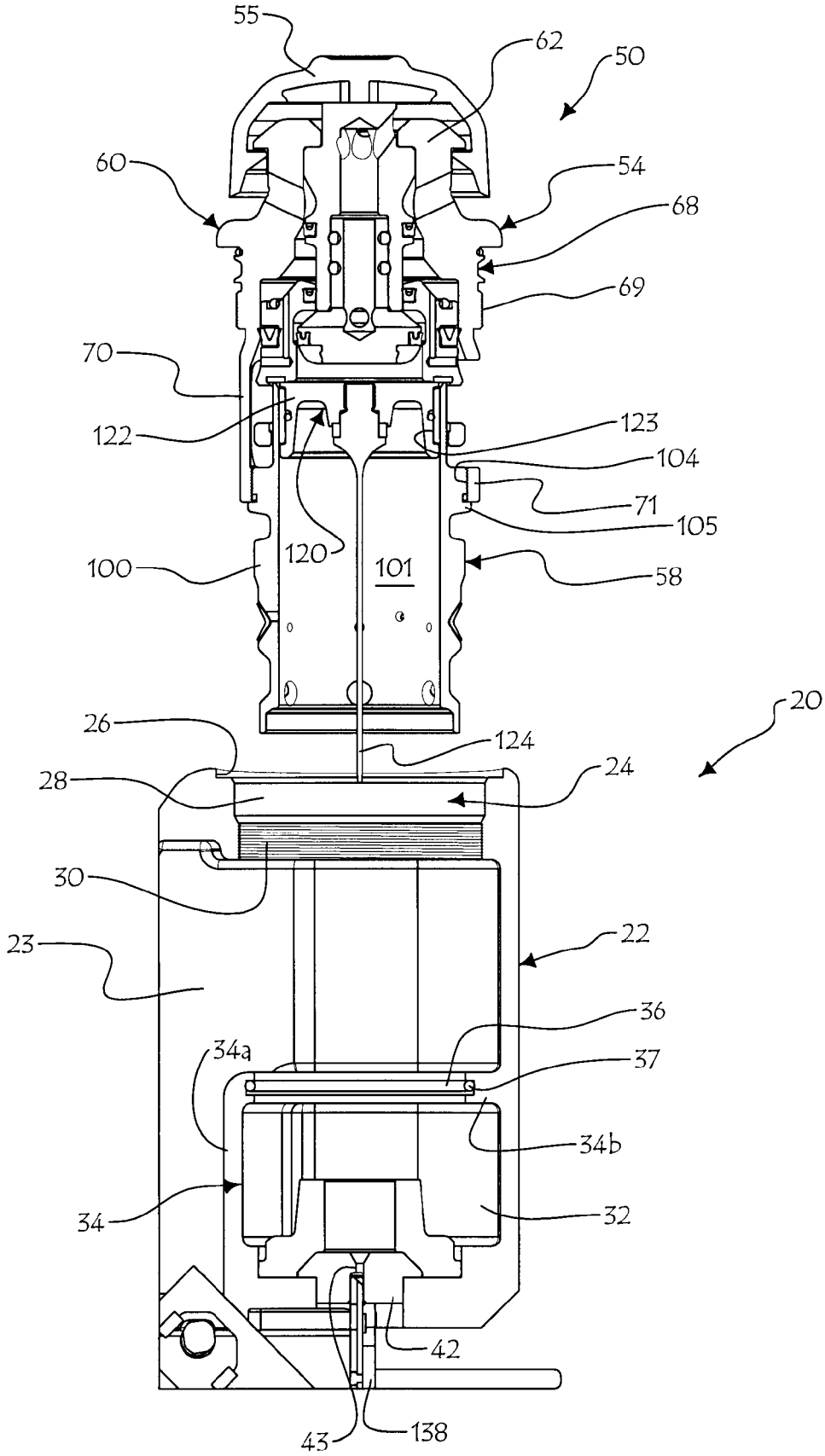
FIG. 8 is a partial sectional elevation of the actuator housing of FIG. 1, and shows the actuator cartridge disconnected from the casing and extracted therefrom.

The threading interconnection of actuator head 54 with casing opening 24 is the only connection fastening actuator cartridge 50 to casing 22. Thus, when actuator head 54 is completely unscrewed and thus disconnected from casing opening 24, the only connection of actuator cartridge 50 to casing 22 is undone, and actuator cartridge 50 can be entirely extracted from casing 22, as shown in FIG. 8. Thus, actuator head 54, piston assembly 58, and their respective constituents can be extracted from casing 22, simply by disconnecting actuator head 54 from casing 22. As actuator cartridge 50 is extracted out of casing 22, plunger 120 clings to the inner peripheral wall of cylinder 100 due to the friction at the contact between sealing band 123 around plunger head 122 and cylinder 100. If ever plunger 120 were to accidentally slide out of cylinder 100 and remain in casing 22 as actuator cartridge 50 is extracted therefrom, the workman could simply insert his hand in the casing or flip the nailer upside down in order to separately extract the plunger from the casing.

Once actuator cartridge has been extracted out of casing 22, the workman can disconnect actuator head 54 from piston assembly 58, by grasping actuator head 54 in one hand, and piston assembly 58 in the other hand and twisting in the "unscrewing" direction. This causes the threads on the inner wall of skirt rim 71 of actuator head 54 to slide against the threads of cylinder annular portion 104 until actuator head 54 and piston assembly 58 detach from each other. Thereafter, actuator head 54 can be further disassembled by sequentially removing its internal constituents (valve, barrel member, etc.), and plunger 120 can be slid out of cylinder 100.

By providing an assembled actuator cartridge 50 which can be connected and disconnected "as one" from casing 22, it becomes significantly easier to clean, repair, lubricate, or generally maintain each individual component of the actuator mechanism. With prior art pneumatic nailers, the casing containing the actuator mechanism had to be opened up in order to gain access to certain components of the actuator mechanism. Advantageously, this is not the case with the present invention.

Once the proper maintenance tasks have been performed on the nailer, it is easy to reassemble the nailer in working configuration. The workman must first reassemble actuator cartridge 50 by following the above disassembly instructions in the reverse order. When actuator cartridge is reassembled, the workman positions plunger head 122 next to the lower end of the cylinder rim 106 in order for the striking rod 124 to be extracted as much as possible from the cylinder 100. The workman then takes note of the orientation of cross-sectionally rectangular guiding piece slit 43, and inserts the actuator cartridge 50 in casing 22 through cartridge insertion opening 24 such that the cross-sectionally rectangular striking rod 124 be properly angularly lined up with guiding piece slit 43. As cartridge 50 is progressively inserted in cartridge insertion opening 24, the lower portion of cylinder 100 enters auxiliary chamber 32 through circular opening 36 made in partition top wall 34*b*, and the striking rod 124 becomes engaged in guiding piece slit 43. The workman then starts to screw actuator head 54 in cartridge insertion opening 24. As actuator head 54 is rotated, all components of the cartridge are rotated therealong with the exception of plunger 120, since its cross-sectionally rectangular striking rod 124 is non-rotatably engaged in guiding piece slit 43. Sealing band 123 around plunger head 122 therefore slides against the inner wall of cylinder 100 as actuator head 54 is screwed to casing 22. The nailer is ready for use when actuator head 54 is tightly screwed in cartridge insertion opening 24.

Figure 13:
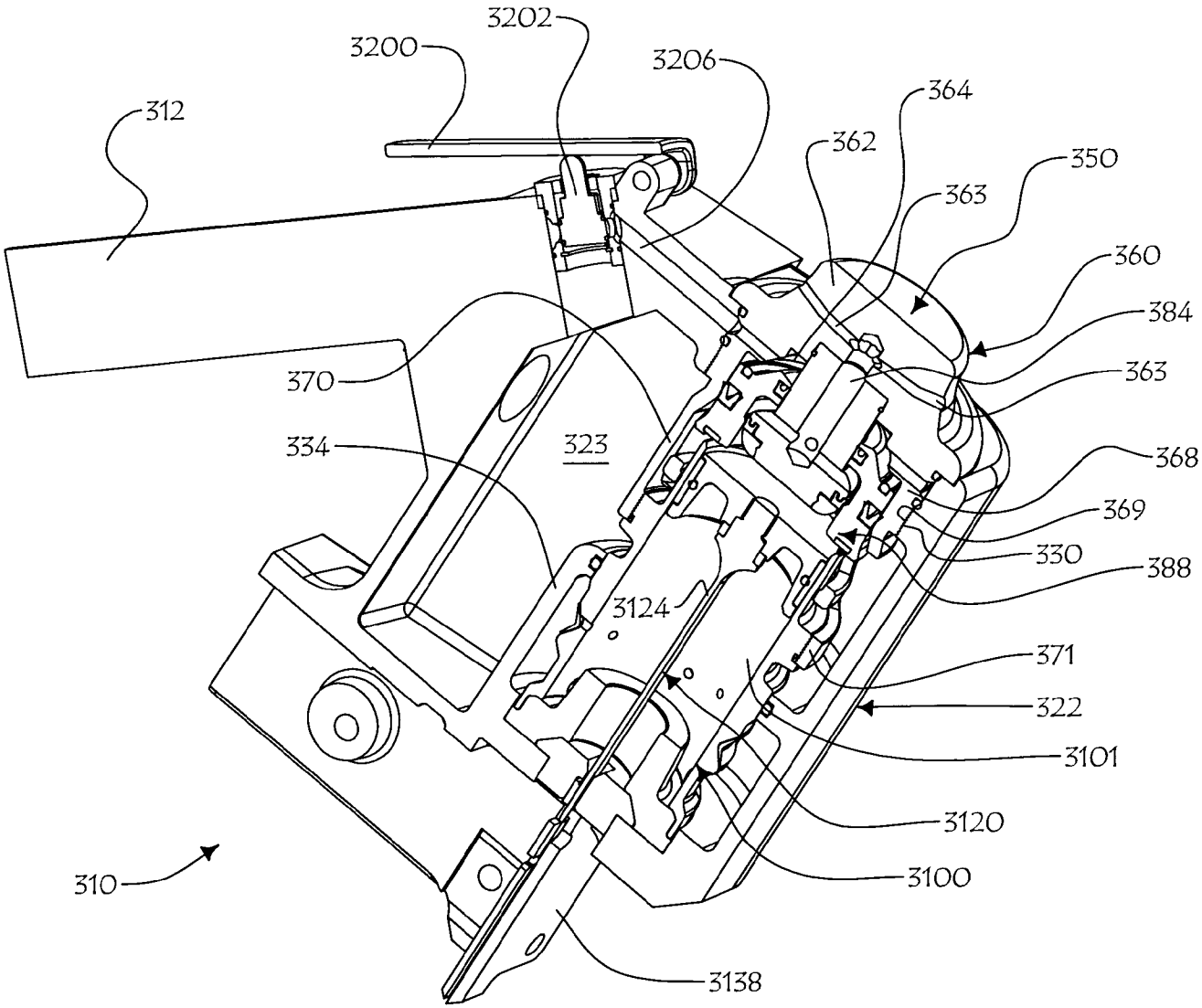
FIG. 13 is a sectional perspective view of a switch-operated nailer according to an alternate embodiment of the invention.
Figure 14:
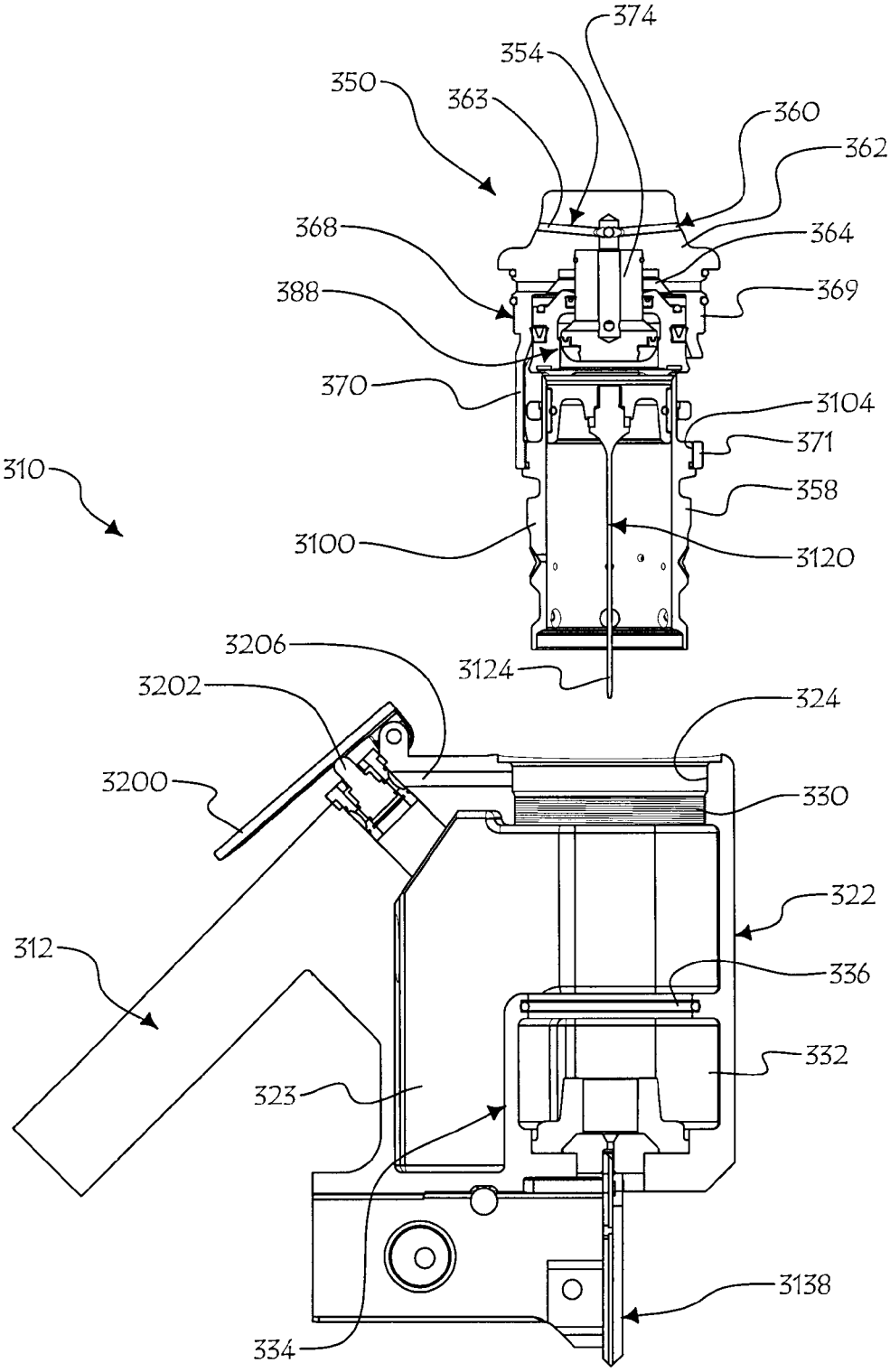
FIG. 14 is a sectional elevation of the switch-operated nailer of FIG. 13, with the actuator cartridge extracted from the casing.

Nailer 10, in which selective activation of the actuator cartridge is accomplished by pounding the actuator head with a mallet, is an exemplary embodiment, and the scope of the present invention should extend to other types of pneumatic nailers, such as the switch-activated nailer 310 of FIGS. 13-14.

Nailer 310 has certain similarities with nailer 10: it comprises a main frame 312 (shaped differently than main frame 12 of nailer 10) in turn defining a casing 322. A fastener receiving assembly 3138 is attached to casing 322. Casing 322 defines therein a main chamber 323, and an auxiliary chamber 332 separated from main chamber 323 by a partition 334. Casing 322 further defines a top circular opening 324 whose peripheral wall inter alia defines a threaded section 330. Within said casing 322 is releasably received an actuator cartridge 350.

Actuator cartridge 350 is similar to cartridge 50 of nailer 10, but is not mallet-operated. It comprises an actuator head 354 having a shell 360, in turn defining an outer portion 362, an intermediate portion 368 defining a threaded section 369 for threading engagement with threaded section 330 of casing circular opening 324, and an inner or skirt portion 370 extending within casing 322. Skirt portion 370 defines a lower rim 371 having a threaded inner wall.

Within actuator head 354 is provided a barrel member 374, which is fixedly or releasably connected to shell 360. Barrel member 374 does not move within actuator head shell 360 during a fastener discharge cycle, contrarily to barrel member 74 of nailer 10. Moreover, valve 388, mounted around barrel member 374 and sliding axially on the upper rim portion of cylinder 3100, does not present air channels such as the L-shaped channels 89 in valve 88 of nailer 10.

Actuator head 354 is releasably connected to a piston assembly 358 by screwing of skirt lower rim 371 around an annular threaded portion 3104 of cylinder 3100 of a subjacent piston assembly 358, as in actuator cartridge 50 of nailer 10 described above. A plunger 3120 carrying a striking rod 3124 is slidably mounted inside cylinder 3100.

In nailer 10, downward movement of barrel member 74 is provoked when someone strikes the actuator head with a mallet. This downward movement of barrel member 74 causes the depressurization of head chamber 64 (as described above), which in turn causes valve 88 to be urged upwardly and allow pressurized air from main chamber 23 to access and flow into the cylinder chamber and forcibly drive the plunger towards its bottom limit position. The downward stroke of the plunger drives its striking rod across to the fastener striking channel in plate assembly 138.

In nailer 310, instead of striking the actuator head with a mallet to trigger a fastener discharge cycle, the workman pushes a switch lever 3200. Switch lever 3200 acts upon a selector valve 3202 which controls inlet of pressurized air inside head chamber 364, above valve 388, via an elongated air channel 3206 made in the thickness of the top wall of casing 322. When switch lever 3200 is not pressed, selector valve 3202 is set to route compressed air from pressurized main chamber 323 into head chamber 364, therefore urging valve 388 towards its closed position. To trigger a discharge cycle of the nailer, the workman applies pressure on the switch lever 3200, which shifts the selector valve 3202 and sets it to cut off communication between head chamber 364 and pressurized main chamber 323, and to establish fluid communication between the atmosphere and head chamber 364. Thus, when a workman depresses the switch lever 3200, head chamber 364 is depressurized as compressed air is exhausted through channel 3206, valve 388 is urged to its open position, and compressed air is thus admitted into cylinder chamber 3101 to urge plunger 3120 towards its bottom limit position. When the workman releases switch lever 3200, head chamber 364 is re-pressurized, valve 388 is urged towards its closed position, and the pressurized air above the plunger head is exhausted through exhaust channel 384 made across barrel member 374 and out into the atmosphere through exhaust holes 363 made across shell 360.

Similarly to actuator cartridge 50 in nailer 10, actuator cartridge 350 in nailer 300 is a unitary structure which can be connected and disconnected as one from casing 322, in order to easily carry out maintenance thereof.

It is understood that the above-described nailer embodiments are exemplary, and various modifications could be made thereto without departing from the scope of the invention as defined in the appended claims.

For example, the fastening means allowing the releasable connection of the actuator head to the piston assembly is formed of matching threaded sections on both the actuator head and the piston assembly. It is understood that any other suitable fastening means could be used instead of mutually screwed threaded portions, for example snap-action fastening means. Similarly, any suitable fastening means could be used to ensure the releasable connection of the actuator cartridge to the nailer's casing, for example snap-action fastening means.

Moreover, in both illustrated embodiments, the actuator cartridge anchoring point to the casing is on the actuator head, i.e. the releasable connection of the actuator cartridge to the casing is achieved by screwing a threaded section of the actuator head shell in a corresponding threaded section of the opening made through the top wall of the casing. It is envisioned that the anchoring point of the cartridge to the casing be located at any other suitable location on the cartridge. The cylinder could for example comprise, on its outer wall, an annular threaded radial projection threadingly engaging mating threads made in the circular opening on the top wall of the partition separating the main chamber from the auxiliary chamber.

Furthermore, in both illustrated embodiments, the shock absorber (no. 44 in the first embodiment of FIG. 2), is snugly friction-fitted in the annular shoulder 40 made on the bottom wall 33 of the auxiliary chamber 32. In alternate embodiments, the shock absorber could instead be friction-fitted within the lower rim of the piston assembly cylinder and could freely rest against the auxiliary chamber shoulder. In such an embodiment, the shock absorber would cling to the inner surface of the cylinder chamber as the piston assembly is extracted out of the casing, and would consequently be extracted out of the casing along with the actuator cartridge.

Also, the plunger should not be limited to carrying a striking rod for directly striking and ejecting fasteners. For example, instead of carrying a striking member for directly striking a fastener, the plunger could carry connecting arms transmitting the axial movement of the plunger head to pivotable arms situated outwardly of said casing, as for example disclosed in co-pending international application No. PCT/CA2005/000804 (inventors Dion et al.). These pivotable arms are in turn operatively connected to an arcuate striking member situated outboard of the casing for striking arcuate fasteners. However, in such an embodiment, the plunger would likely not be extracted along with the cylinder as the actuator cartridge is extracted from the nailer's casing.

The "backstroke" of the plunger, i.e. its return to its upper limit position, was accomplished in the above-described embodiments by providing an auxiliary chamber (chamber 32) separated from main chamber 23, and communicating with cylinder chamber 101 through unidirectional air exhaust holes 108 and through transfer holes 112. When the plunger reaches its lower limit position, the auxiliary chamber becomes pressurized as compressed air flows from the main chamber into the cylinder chamber, and in turn from the cylinder chamber into the auxiliary chamber through unidirectional air exhaust holes 108. When the pressure above the plunger drops to atmospheric pressure, the compressed air in auxiliary chamber 32 flows back into cylinder chamber 101 beneath plunger head 122 through transfer holes 112 and urges the plunger back to its upper limit position.

The nailer casing and the actuator cartridge could be configured differently, such that the "backstroke" of the piston be accomplished as described in the above-mentioned international application No. PCT/CA2005/000804. In this international application, the auxiliary chamber communicates permanently with the main chamber, and the inner chamber of the cylinder has a variable diameter. More particularly, the cylinder chamber comprises a lower tier having a smaller inner diameter than an upper tier of the cylinder. The plunger head, on the other hand, is I-shaped, and an annular chamber is formed between the variable-diameter cylinder inner peripheral wall and the plunger head's outer peripheral wall; this annular chamber communicates permanently with the auxiliary chamber via holes made through the cylinder. Due to the shape of the plunger head and of the variable-diameter cylinder inner chamber, the piston is constantly biased upwardly towards its upper limit position when the main chamber is pressurized. When compressed air is admitted in the cylinder above the plunger head as the valve opens (at the beginning of a nail discharge cycle), this compressed air acts on the wide upper surface of the plunger head and overwhelms the bias exerted on the plunger by the compressed air from within the annular chamber formed between the plunger head and the cylinder, and urges the plunger towards its lower limit position. However, when the valve closes (towards the end of the nail discharge cycle) and the pressure above the plunger head drops back to atmospheric pressure, the plunger can be urged back automatically to its upper limit position under the action of this upward "backstroke" bias. It is generally understood that the scope of the present invention could extend to any actuator composition and configuration coming within the scope of the appended claims, and should not be limited to the specific actuator configurations described above. For example, the actuator cartridge could comprise an actuator head and a cylinder fastened thereto, and could further comprise a concentric double-piston configuration as shown in U.S. Pat. No. 3,542,273 (inventor G. R. Hedrick). In this embodiment, the plunger is composed of a striking rod mounted to a plunger head, the plunger head comprising in turn a discoid member defining a toroidal groove on its upper surface, and a hollow mounting rod mounted to the discoid member and further concentrically and telescopically mounted within a tubular member affixed and depending downwardly from the actuator head.

The invention claimed is:

1. An actuator housing for use on a pneumatic nailer, said actuator housing comprising:

a casing, at least partially hollow, defining a cartridge insertion opening;

a selectively activated actuator cartridge which can be inserted in said casing through said cartridge insertion opening, said actuator cartridge comprising:

an actuator head for sealing engagement with said cartridge insertion opening of said casing, said actuator head extending at least partially outwardly of said casing, a piston assembly received at least partially within said casing, said piston assembly comprising a tubular member defining a tubular member chamber therein and a plunger at least partially movably mounted within said tubular member chamber;

first means for fastening said actuator head to said tubular member of said piston assembly; and releasable second means for fastening said actuator cartridge releasably to said casing;

wherein upon selective activation of said actuator cartridge, said plunger is actuated along said tubular member chamber for striking a fastener, and wherein said second means for fastening can be released to disconnect said actuator cartridge from said casing; wherein said tubular member is a cylinder, and said tubular member chamber is a cylinder chamber; and wherein said second means for fastening comprise an annular threaded section of said actuator head and an annular threaded section of said cartridge insertion opening, to allow said actuator head to be screwed into said cartridge insertion opening.

2. The actuator housing according to claim 1, wherein said releasable second means for fastening connects said actuator head to said casing.

3. The actuator housing according to claim 1, wherein said first means for fastening are releasable.

4. The actuator housing according to claim 1, wherein said actuator head defines an inner portion extending within said casing, said first means for fastening are defined by an annular threaded section of said actuator head inner portion and an annular threaded section of said cylinder, to allow said actuator head inner portion and said cylinder to be screwed together.

5. The actuator housing according to claim 4, wherein said threaded sections of said first means for fastening define a first thread pitch, and said threaded sections of said second means for fastening define a second thread pitch greater than said first thread pitch, wherein the difference between said first and second thread pitches provides for a number of turns required to release said first means for fastening greater than the number of turns required to release said second means for fastening.

6. The actuator housing according to claim 4, wherein said actuator head inner portion defines air inlets made therethrough.

7. The actuator housing according to claim 1, wherein said casing defines a striking member opening, and said plunger carries a striking member engageable in said striking member opening, said striking member being for striking fasteners.

8. The actuator housing according to claim 7, wherein said plunger comprises a plunger head carrying said striking member, said plunger head being slidably movable within said tubular member chamber between a first limit position and a second limit position.

9. The actuator housing according to claim 7, wherein said casing comprises a guiding piece defining a slit therethrough, said guiding piece slit forming said striking member opening.

10. An actuator housing for use on a pneumatic nailer, said actuator housing comprising:

a casing, at least partially hollow, defining a cartridge insertion opening;

a selectively activated actuator cartridge which can be inserted in said casing through said cartridge insertion opening, said actuator cartridge comprising:

an actuator head for sealing engagement with said cartridge insertion opening of said casing, said actuator head extending at least partially outwardly of said casing, a piston assembly received at least partially within said casing, said piston assembly comprising a tubular member defining a tubular member chamber therein and a plunger at least partially movably mounted within said tubular member chamber;

first means for fastening said actuator head to said tubular member of said piston assembly; and releasable second means for fastening said actuator cartridge releasably to said casing;

wherein upon selective activation of said actuator cartridge, said plunger is actuated along said tubular member chamber for striking a fastener, and wherein said second means for fastening can be released to disconnect said actuator cartridge from said casing;

wherein said casing defines a pressurized main chamber, and wherein said actuator cartridge further comprises a valve;

wherein when said actuator cartridge is at rest, said valve is closed and fluid communication between said pressurized main chamber and a portion of said tubular member chamber above said plunger is prevented, and wherein upon activation of said actuator cartridge, said valve opens and fluid communication between said tubular member chamber above said plunger and said pressurized main chamber is established to enable pressurized air to act on said plunger and urge it from a first limit position towards a second limit position.

11. The actuator housing according to claim 10, wherein said actuator head defines a selectively depressurizable head chamber therein in which said valve is movably mounted, and said tubular member chamber defines an air inlet opening, wherein when said actuator cartridge is at rest, said head chamber is pressurized and said valve is moved towards said tubular member air inlet opening and blocks fluid communication between said tubular member chamber above said plunger and said pressurized main chamber, and when said actuator cartridge is activated, said head chamber is depressurized and said valve is moved away from said tubular member air inlet opening and permits fluid communication between said tubular member chamber above said plunger and said pressurized main chamber.

12. A nailer for driving fasteners, comprising:

a frame, in turn comprising a casing, said casing being at least partially hollow and defining a cartridge insertion opening and a strike member opening;

a selectively activated actuator cartridge which can be inserted in said casing through said cartridge insertion opening, said actuator cartridge comprising:

an actuator head for sealing engagement with said cartridge insertion opening of said casing, said actuator head extending at least partially outwardly of said casing, a strike motion assembly received at least partially within said casing, said strike motion assembly comprising a chamber member having a wall circumscribing a chamber member enclosure, a strike member mounted to said chamber member, said strike member having a portion engageable in said strike member opening, said strike member for striking and ejecting loose fasteners; and a means for mounting said strike member to said chamber member for relative movement of said striking portion into said chamber member enclosure;

first means for fastening said actuator head to said chamber member of said strike motion assembly; and releasable second means for fastening said actuator cartridge to said casing;

a fastener receiving member, for receiving loose fasteners to be driven outwardly of said nailer;

wherein upon selective activation of said actuator cartridge, said strike member is actuated along said chamber member, and wherein said second means for fastening can be released to disconnect said actuator cartridge from said casing; wherein said strike motion assembly consists of a piston assembly, said chamber member comprises a cylinder, and said strike member is a plunger movably mounted in reciprocating fashion within said cylinder; and wherein said second means for fastening comprises an annular threaded section of said actuator head and an annular threaded section of said cartridge insertion opening, to allow said actuator head to be screwed into said cartridge insertion opening.

13. The actuator housing according to claim 12, wherein said releasable second fastening means connects said actuator head to said casing.

14. The actuator housing according to claim 12, wherein said first fastening means are releasable.

15. The actuator housing according to claim 12, wherein said actuator head defines an inner portion extending within said casing, said first means for fastening are defined by an annular threaded section of said actuator head inner portion and an annular threaded section of said cylinder, to allow said actuator head inner portion and said cylinder to be screwed together.

16. The actuator housing according to claim 15, wherein said threaded sections of said first means for fastening define a first thread pitch, and said threaded sections of said second means for fastening define a second thread pitch greater than said first thread pitch, wherein the difference between said first and second thread pitches provides for a number of turns required to release said first means for fastening greater than the number of turns required to release said second means for fastening.

17. The actuator housing according to claim 15, wherein said actuator head inner portion defines air inlets made therethrough.

* * * * *